US005967750A

United States Patent [19]

Elliott

[11] Patent Number: 5,967,750

[45] Date of Patent: Oct. 19, 1999

[54] VARIABLE PITCH MARINE PROPELLER

[76] Inventor: Morris C. Elliott, 11723 Norino Dr., Whittier, Calif. 90601

[21] Appl. No.: 08/949,021

[22] Filed: Oct. 10, 1997

[51] Int. Cl.[6] ..... B63H 3/04

[52] U.S. Cl. ..... 416/61; 416/157 R; 416/159; 416/167; 416/168 R; 416/166; 440/50; 440/900

[58] Field of Search ..... 416/61, 157 R, 416/159, 167, 168 R, 166; 440/50, 900; 74/531, 102, 105, 109; 60/534; 91/1; 92/5 R

[56] References Cited

U.S. PATENT DOCUMENTS

| | | | |
|---|---|---|---|
| 2,425,261 | 8/1947 | Murphy et al. | 416/157 R |
| 2,992,632 | 7/1961 | Nichols | 60/534 |
| 3,051,249 | 8/1962 | Dirlik . | |
| 3,216,507 | 11/1965 | Curioni . | |
| 3,338,313 | 8/1967 | Tolley et al. | 416/157 R |
| 3,738,191 | 6/1973 | Fadden et al. | 74/531 |
| 4,075,899 | 2/1978 | Bartholomew et al. | 74/102 |
| 4,362,467 | 12/1982 | Elliot | 416/157 R |
| 4,952,083 | 8/1990 | Kuehl . | |
| 5,464,040 | 11/1995 | Johnson | 137/556 |

OTHER PUBLICATIONS

Miller, Cort L., Mark's Standard Handbook of Mechanical Engineering (New York, McGraw–Hill, Jan. 1, 1987), pp. 8–131–138.

International Search Report; Mar. 3, 1999; 6 p.

*Primary Examiner*—Edward K. Look
*Assistant Examiner*—Matthew T. Shanley
*Attorney, Agent, or Firm*—Sheldon & Mak

[57] ABSTRACT

A variable-pitch marine propeller system has a propeller unit for mounting on a drive shaft, and a power unit including a stationary annular hydraulic cylinder for operating the propeller unit, a hydraulic remote control unit being fluid-coupled to the power unit. An annular piston of the hydraulic cylinder is coupled to a ring-shaped actuator yoke by a roller thrust bearing, the actuator yoke axially displacing a mating yoke of the propeller unit with which the actuator yoke is allowed to rotate. The piston operates in a sealed environment for the exclusion of water from the separately sealed surfaces of the cylinder itself. In one configuration, the propeller unit is replaceable without disturbing the sealed environment of the annular piston. The control unit includes a hydraulic control cylinder that is operated by a rotatably mounted barrel that engages a threaded piston rod. Alternatively, the control cylinder is actuated by a lever having biasing springs and an adjustable brake.

29 Claims, 5 Drawing Sheets

VARIABLE PITCH MARINE PROPELLER

BACKGROUND

The present invention relates to propeller propulsion devices, and more particularly to variable pitch propeller devices for marine craft such as inboard and outboard pleasure boats, yachts and fishing boats.

Variable pitch aircraft propellers are well known, implementations including hydraulic actuators being disclosed, for example, in U.S. Pat. Nos. 2,425,261 to Murphy et al., 2,554,611 to Biermann, and 4,362,467 to the present inventor. The '467 patent, which is incorporated herein by this reference, discloses a mounting flange for mounting to the propeller shaft flange of an engine, a hub for pivotally supporting a plurality of blades on respective radial axes, and a stationary annular hydraulic cylinder and piston between the mounting flange and the hub, the piston being connected by a yoke and transverse pin to a longitudinal rack member that engages respective pinions of the blades to rotate same through a wide angle of approximately 90°.

Typical marine propeller installations include a rearwardly extending propeller shaft on which is mounted a one-piece propeller having an annular hub portion, the shaft extending through the hub and threadingly engaging a retainer nut. The hub is secured against rotation relative to the shaft such as by splined engagement or by one or more keys or shear pins.

The aircraft propeller implementation of the '467 patent, while having certain advantages including the stationary annular hydraulic cylinder, is unsuitable for use in typical marine applications for a number of reasons. For example:

1. The shaft interferes with placement and movement of the yoke pin and the rack member;

2. The rear of the hub, including a biasing spring mechanism therein, interferes with access to the nut whereby the hub would be secured to the shaft;

3. The hub and blades would be difficult to remove for servicing and/or replacement in case of damage by underwater hazards; and 4. The device would be subject to water damage in that hub is unsealed, and the piston seals would have to operate in a wet environment.

Thus there is a need for a variable pitch marine propeller that is effective for providing a wide angular range, that is compatible with existing fixed-pitch installations, that is easy to service, repair, and replace, and is resistant to water damage.

SUMMARY

The present invention meets this need by providing a modular variable pitch system configuration of propeller and stationary annular actuator for facilitating assembly, servicing and replacement particularly of parts most subject to damage by under-water hazards. The system is adapted for marine drives including a driven shaft having a locating surface, a torque-transmitting surface, and a retainer surface for engagement by a retaining device, the shaft extending from a base structure such as a drive housing. In one aspect of the invention, a modular variable pitch propeller system includes a power unit having a spindle for coupling to the shaft and rotation therewith, an annular hydraulic cylinder rotatably supportable relative to the spindle and having a fluid port and means for preventing rotation of the cylinder by mechanical coupling to the base structure, a piston slidably engaging the cylinder in sealed relation therewith and coupling fluid flow relative to the port with axial movement of the piston, a piston yoke axially movably supported relative to the spindle, a first thrust bearing for transmitting axial force between the spindle and the cylinder, and a second thrust bearing for transmitting axial force between the piston and the piston yoke; and a propeller unit having a hub for coupling to the shaft for rotation therewith, a plurality of radially projecting blade members movably supported relative to the hub, a propeller yoke axially movable relative to the hub, and means for moving the blade members relative to the hub in response to axial movement of the propeller yoke. The piston yoke moves axially relative to the spindle in response to fluid flow into the port, and the spindle and the piston yoke can be rotated by the shaft while the cylinder and the piston are being prevented from rotation by the coupling to the base.

The power unit is locatable adjacent the propeller unit opposite the retainer device whereby the axial force is transmitted from the locating surface, through the power unit to the propeller yoke by the piston yoke, and through the means for moving and the hub to the retainer device. The axial movement of the propeller yoke causes the blade members to move from a first position toward a second position relative to the hub in response to the fluid flow into the port. Preferably the first and second thrust bearings are antifriction bearings that can be needle thrust bearings.

The system can further include means for biasing the piston against the fluid flow into the port for retraction of the piston relative to the cylinder when fluid is allowed to flow out of the port, in response to reduced fluid pressure, the blade members correspondingly moving toward the first position. The biasing means can include a spring for urging the propeller yoke axially toward the piston yoke relative to the hub.

The shaft is operable submerged in water, and the system can further include power unit seal means for excluding water from the piston and the thrust bearings. The seal means can include a rotary first seal between the spindle and the cylinder, a rotary second seal between the spindle and the piston yoke, and an axial third seal between the cylinder and the piston yoke. Alternatively the seal means includes a rotary first seal between the spindle and the cylinder, and a rotary second seal between the cylinder and the hub.

The means for preventing rotation can include the fluid port being formed for engagement by a hydraulic fitting having a conduit extending therefrom, and a mechanical connection between the conduit and the base. Preferably the spindle is adapted for being clamped between the locating surface and the hub by the retainer device.

Preferably the system further includes radial bearing means for concentrically supporting the cylinder relative to the spindle. The radial bearing means can include a needle bearing assembly fixedly located within the cylinder and rollably engaging the spindle.

The means for moving can include each blade member being rotatably mounted on a respective radially extending axis of the hub and having a pinion fixedly connected thereto, and the propeller yoke including axially extending rack elements engaging corresponding ones of the pinions. The system can include two of the blade members that project from opposite sides of the hub, or three of the blade members that project in equally spaced relation to the hub.

The system can further include a control device being fluid-connected to the fluid port and including a hydraulic control cylinder having a control port, a control piston sealingly axially movable in the control cylinder, conduit means for fluid-connecting the control port to the fluid port of the annular hydraulic cylinder, means for adjustably positioning the control piston, and means for holding the control piston against hydraulic pressure being used for operating the power unit. The means for positioning the control piston can include a control lever coupled thereto, the means for holding including control biasing means and a friction brake coupled between the control piston and the control cylinder. Alternatively, the means for positioning the control piston includes a threaded control rod coupled thereto, a control knob rotatably mounted relative to the control cylinder and threadingly engaging the control rod for axial movement thereof, an indicator element extending from the control rod and being exposed for indicating relative position of the control piston, and the means for holding comprises a working angle of engagement between the control rod and the knob being sufficiently high to frictionally lock the nut against rotation in response to axial loading of the control rod.

DRAWINGS

These and other features, aspects, and advantages of the present invention will become better understood with reference to the following description, appended claims, and accompanying drawings, where:

DESCRIPTION

Figure 1:
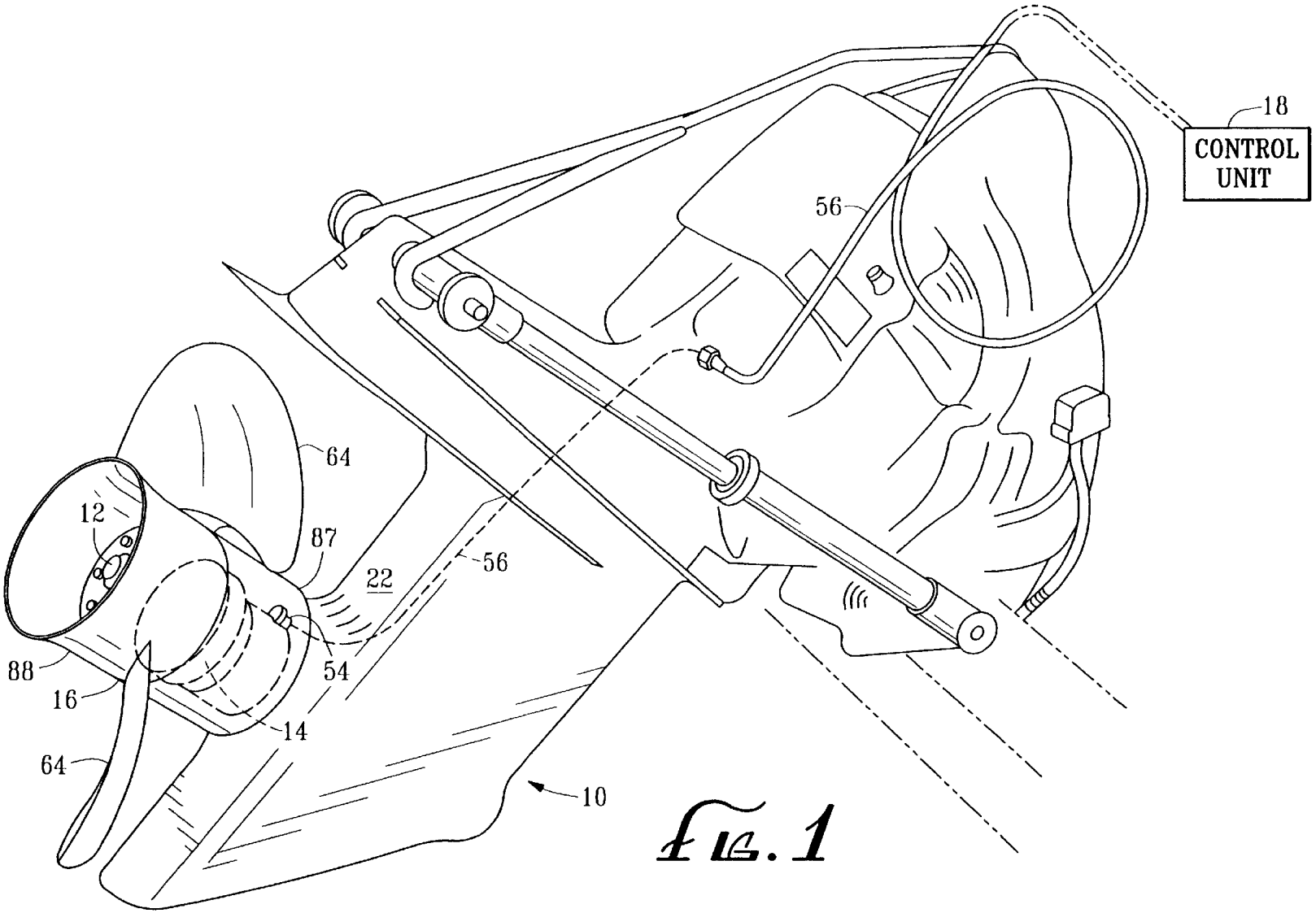
FIG. 1 is a perspective view of a variable pitch propeller system according to the present invention, the system being installed on an existing outboard watercraft engine.

The present invention is directed to a variable pitch propeller system that is particularly effective in marine environments. With reference to FIGS. 1–4 of the drawings, a propeller system 10 for a shaft drive 12 includes a power unit 14, a propeller unit 16, and a control unit 18 being fluid-connected to the power unit as described below. The shaft drive 12 is representative of typical existing hardware, having a propeller shaft 20 rearwardly extending from a base structure 22 that can be a hull member or an outboard drive housing. The shaft 20 is formed with an engagement surface 24 having a tapered portion 25 for locating a conventional propeller (not shown), a cylindrical portion 26, splined portion 27 for transmitting torque to the conventional propeller, and a threaded portion 28 for engagement by a retainer nut 29 by which the conventional propeller is clamped against the tapered portion 25. The power unit 14 of the propeller system 10 includes a spindle 30 for coupling to the shaft 20 by location on the tapered portion 25 and the cylindrical portion 26 of the engagement surface, optionally by using an adapter sleeve 31 for facilitating use of a singly configured spindle 30 with a plurality of differently configured propeller shafts 20. An annular hydraulic cylinder 32 is supported in concentric relation to the spindle 30, the cylinder 32 having a piston 34 being axially slidable in sealed relation therewith, denining annular fluid cavity 35, the cylinder 32 also having a port member 36 fixedly extending therefrom. The port member 36 has a threaded fluid port 37 formed therein for receiving a suitable hydraulic fluid as further described below, the port 37 being fluid-connected to the cylinder 32 by a port passage 38 for axially displacing the piston 34. The port member 36 can be integrally formed with the cylinder 32, or fastened thereto as shown in the drawings, an O-ring 39 sealing the passage 38.

The power unit 14 also includes a piston yoke 40 for operating the propeller unit 16 as described below, and antifriction bearings for transmitting axial forces while permitting rotation of the spindle 30 and the piston yoke 40 with the shaft 20 while the hydraulic cylinder 32 and the piston 34 are restrained from rotation. A first needle or roller thrust bearing 42 is located between the spindle 30 and the hydraulic cylinder 32; a second such thrust bearing 44 is located between the piston 34 and the piston yoke 40, for transmitting axial force to the piston yoke 40; and a radial needle bearing 46 is located within the cylinder 32 for engagement by the cylindrical portion 26 of the propeller shaft 20 to thereby maintain concentricity of the cylinder 32 with the shaft 20.

The piston 34 is provided with respective outside and inside ring seals 48 and 49 that sealingly contact corresponding finished surfaces of the hydraulic cylinder in a conventional manner. According to the present invention, the power unit has further seals for excluding water and foreign matter from the surfaces contacted by the ring seals 48 and 49. In one exemplary configuration and as shown in FIG. 3, a rotary first seal 50 is supported by the cylinder 32 for sealingly contacting a front portion of the spindle 30; a rotary second seal 51 is supported by an inside surface of the piston yoke 40 for sealingly contacting a rear portion of the spindle 30; and an axial third seal 52 is supported by the cylinder 32 for sealingly contacting an outside surface of the piston yoke 40.

Figure 3:
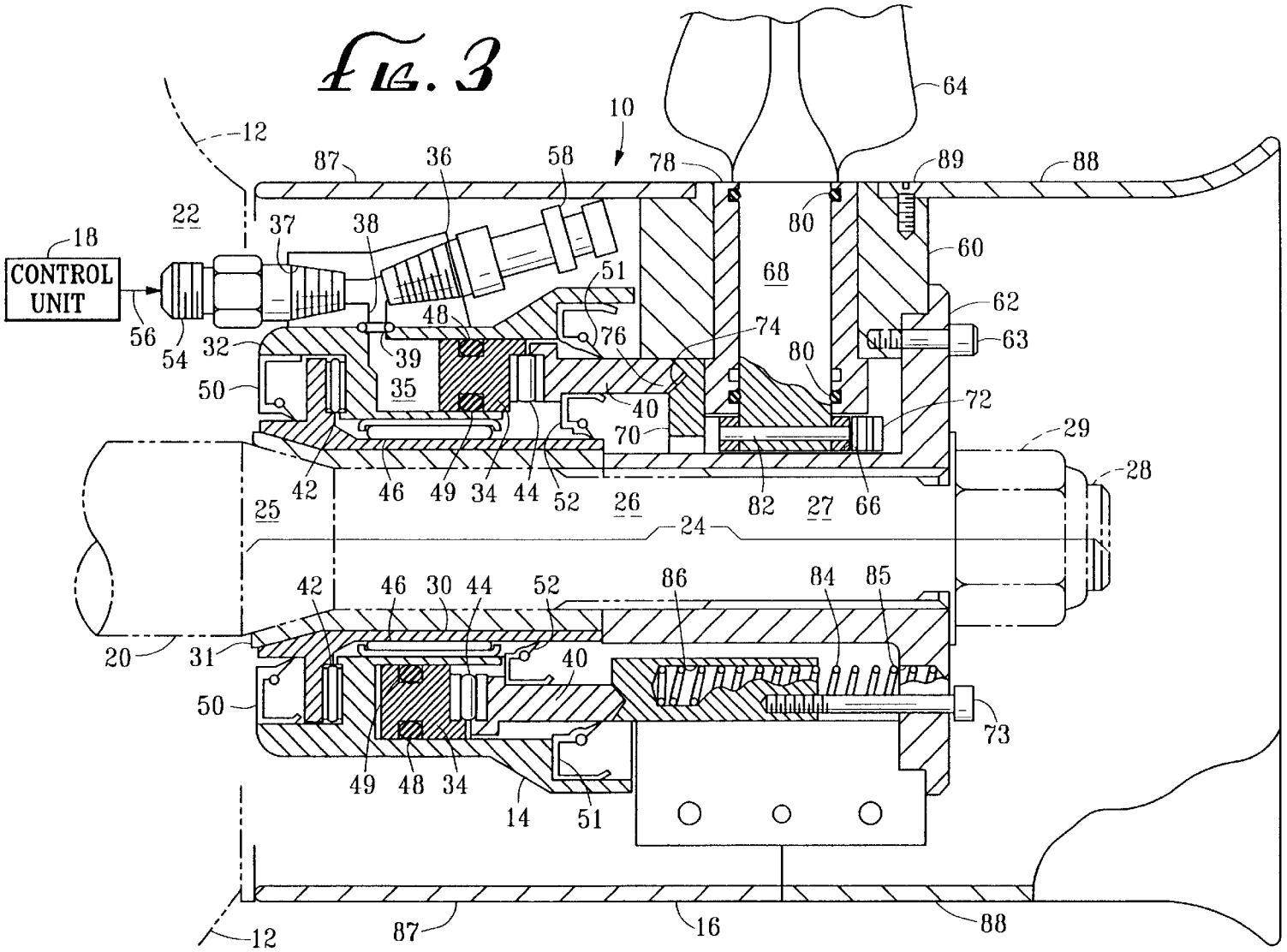
FIG. 3 is a fragmentary lateral sectional view of the propeller system of FIG. 1 on line 3—3 in FIG. 2.

The threaded port 37 is provided with a feed fitting 54 by which the control unit 18 is fluid-connected to the power unit 14 through a suitable conduit 56 (schematically shown in FIG. 3). The port member 36 (alone or in combination with the fitting 54) provides a mechanical connection point for restraining the hydraulic cylinder 32 from rotating with the spindle 30. For example, rotational restraint can be achieved by the fitting 54 extending between opposite walls of the base member 22, or by anchoring the conduit 56 to the base member 22 proximate the fitting 54. The port member 36 is also formed for supporting a bleed valve 58 in fluid communication with the passage 38, by which air can be bled from control unit 18.

The propeller unit 16 includes a hub 60, a splined flange member 62 coupling the hub 60 to the splined portion 27 of the shaft 20, the flange member 62 being affixed to the hub 60 by a plurality of flange fasteners 63. A plurality of radially extending blade members 64 are rotatably supported by the hub, each blade member 64 having a pinion 66 on a stem portion 68 thereof. The propeller unit 16 also includes a ring-shaped propeller yoke or rack member 70 having a plurality of radial rack sections 72 formed thereon for engaging corresponding ones of the pinions 66, the rack member 70 being axially slidably supported on a portion of the flange member 62 that extends within the hub 60. A plurality of stop fasteners 73 rigidly project from the rack member 70 in parallel relation to the shaft 20, each of the stop fasteners 73 projecting through the flange member 62.

Figure 2:
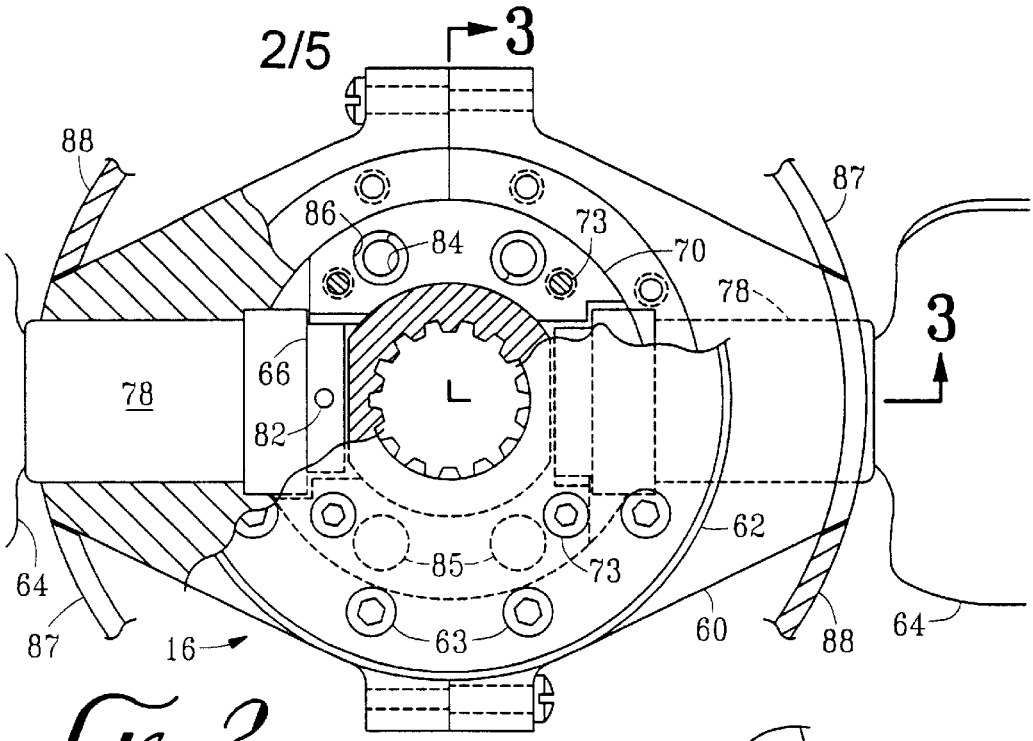
FIG. 2 is an axial sectional view of a propeller unit portion of the propeller system of FIG. 1.

The rack member 70 is formed with an annular groove 74 for engaging a complementary annular projection 76 of the piston yoke 40, the groove 74 and the projection 76 acting to help maintain concentricity of the yoke 40 and rack member 70 relative to the hub 60 and the flange member 62. Each of the blade members 64 is supported in the hub 60 by a respective bearing member 78 that rotatably engages the corresponding stem portion 68, each bearing member 78 having a spaced pair of internal O rings 80 for sealingly retaining a suitable lubricant such as grease therebetween. The blade members 64 are axially secured in the bearing members 78 by the pinions 66 being pinned to the stem portions using respective pin members 82. Inward portions of the bearing members 78 are formed as enlarged flange portions 79 for retention by counterbored portions of the hub 60 as best shown in FIG. 2, thereby securing the blade members 64 against outward movement from the hub 60. Inward movement of the blade members 64 (and the bearings 78) is blocked by respective flattened portions of the flange member 62 contacting end extremities of the stem portions 68 as best shown in FIG. 3, the flattened portions also providing clearance for the pinions 66. Rotational alignment of the rack member 70 relative to the hub 60 for maintaining geared engagement of the pinions 66 by the rack sections 72 is maintained by the flange portions 79 of the bearing members 78 contacting the rack member 70 opposite respective ones of the rack sections 72. Alternatively, the rotational alignment can be maintained by sliding engagement of the stop fasteners 73 with the flange member 62.

The extension of flange member 62 through the hub 60 axially contacts the spindle 30 of the power unit 14, the spindle 30 and the flange member 62 being clamped between the tapered portion 25 of the shaft 20 and the retainer nut 29. The propeller unit 16 is removable from the shaft 20 (following removal of the retainer nut 29) without disturbing the power unit 14. Advantageously, the sealing of the combination of the hydraulic cylinder 32 and the piston 34 by the seals 50, 51 and 52 remains intact during removal and replacement of the propeller unit 16.

Axial movement of the piston yoke 40 in response to pressure fluid flow into the hydraulic cylinder 32 produces corresponding axial movement of the rack member 70, and proportional rotation of the blade members 64 relative to the hub 60, the rotation resulting from geared engagement of the pinions 66 with the radial rack sections 72 of the rack member 70. The propeller unit 16 is also provided with a plurality of compression springs 84 for oppositely rotating the blade members 64 while returning the rack member 70, the yoke 40 and the piston 34 toward the passage 38 when fluid pressure is released therefrom. Opposite ends of each compression spring 84 are located in respective flange and yoke cavities 85 and 86 that are formed in the flange member 62 and the rack member 70. The stop fasteners 73 set the maximum forward angular orientation or pitch of the blade members 64, and limit axial movement of the rack member 70 out of the hub 60, thereby keeping the propeller unit 60 intact when it is removed from the shaft 20. In a preferred implementation, the maximum forward pitch at the tips of the blade members 64 is approximately 54 degrees. (A standard fixed-pitch 140 HP propeller has a tip angle of approximately 44 degrees.) At the opposite extremity of the axial movement, a maximum reverse pitch of 25 degrees is attained. The compression springs 84 provide a total of approximately 300 pounds of biasing against movement of the piston 34. Additionally (or alternatively), the blade members 64 are formed to provide rotational torque reactions against the piston 34 in response to advancement in a water (or air) fluidic medium.

As further shown in FIGS. 1–3, the propeller unit 16 is provided with tubular front and rear shrouds 88 that promote smooth fluid flow from the base member 22 and past the blade members 64. Each of the shrouds 87 and 88 is appropriately notched to clear the bearing members 78 of the blade members 64, being fastened to the hub 60 by a plurality of shroud fasteners 89. Also, the hub 60 is segmented for facilitating fabrication thereof and for facilitating assembly of the propeller unit 16. The exemplary configuration of the propeller unit shown in FIGS. 1 and 2 has a pair of the blade members 64 extending radially from opposite sides of the shaft 20, the blade members 64 being controllably rotatable within the radially oriented bearings 78 as described above for altering the pitch of the blade members. As further described below, the propeller unit 16 can be provided with three or more of the blade members.

Figure 4:
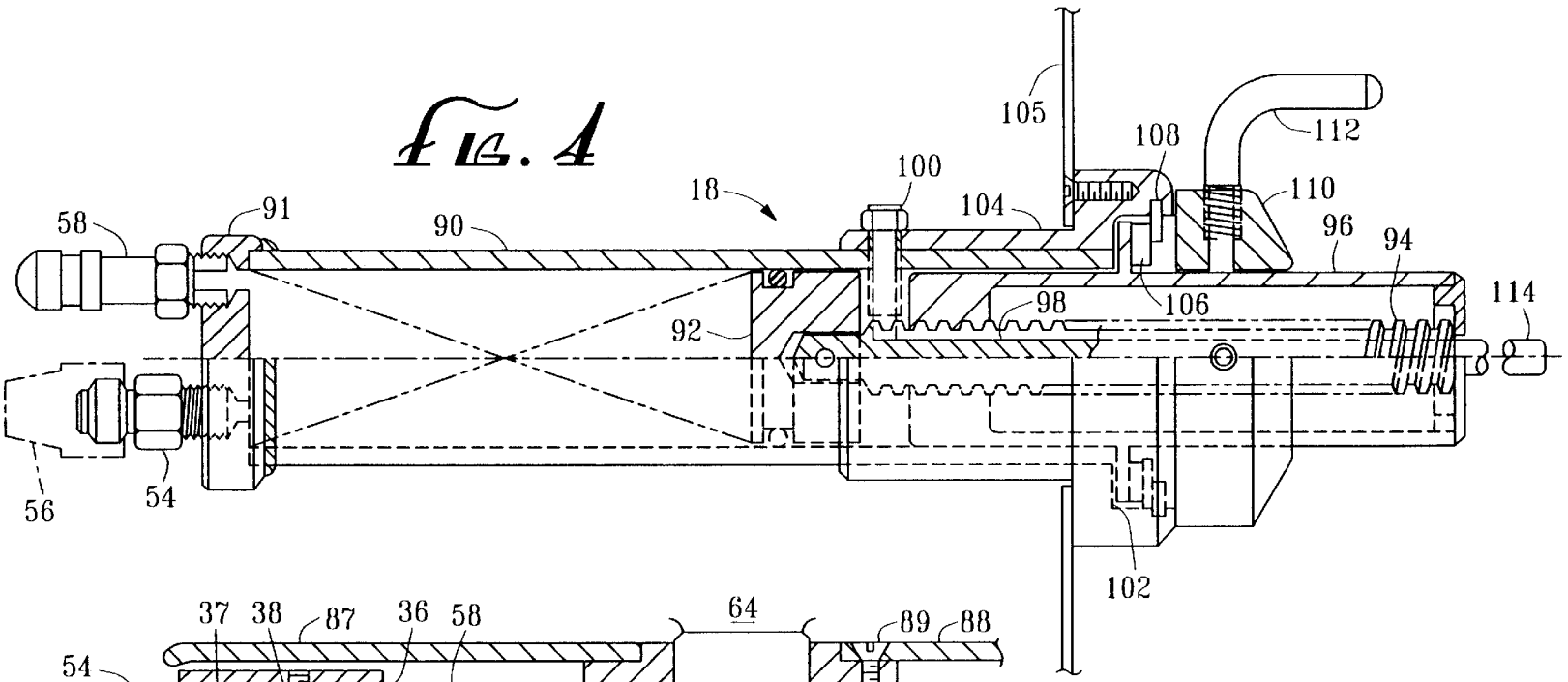
FIG. 4 is a lateral sectional view of a control unit portion the propeller system of FIG. 1.

An exemplary configuration of the control unit 18, depicted in FIG. 4, corresponds generally to a control device as described in the above-referenced U.S. Pat. No. 4,362,467. The control unit 18 includes a hydraulic control cylinder 90 having a control piston 92 therein and having a threaded piston rod 94 extending therefrom. A rotatably supported barrel member 96 threadingly engages the piston rod for axially positioning the piston 92 in the cylinder 90. The piston rod 94 has a longitudinal groove 98 formed therein, a key pin 100 slidably engaging the groove 98 for preventing rotation of the rod 94. The cylinder 90 has a head portion 91 opposite the piston rod 94, counterparts of the fitting 54 and the bleed valve 58 being mounted on the head portion 91 in fluid communication with the cylinder 90, the conduit 56 being connected to the fitting 54.

The barrel member 96 has an outwardly extending flange portion 102, one face of which rotatably engages an anchor sleeve 104 of the cylinder 90, a roller thrust bearing 106 that is retained in the anchor sleeve 104 by a conventional retainer ring 108. The sleeve 104 is adapted for mounting through a stationary member, such as a control panel 105. A handle collar 110 is fixably mounted on the barrel member 96 and having an L-shaped crank member 112 rigidly extending therefrom for facilitating manual rotation of the barrel member 96. The thrust bearing 106 axially supports the barrel member during forced advancement of the control piston 92 toward the fitting 54, movement in the opposite direction being generally unopposed in that the springs 84 of the propeller unit 16 are effective for driving the blade members 64, the rack member 70, the yoke 40, and the piston 34 to produce fluid flow into the control cylinder 90 during retraction of the control piston 92. The piston rod 94 has a stem extremity 114 that projects from the barrel member 96 for indicating relative positions of the piston 92, thereby providing visual indications of propeller pitch settings of the system 10. The stem extremity 114 can have colored striping for designating particular pitch ranges such as forward (high and low pitch), neutral, and reverse.

Figure 5:
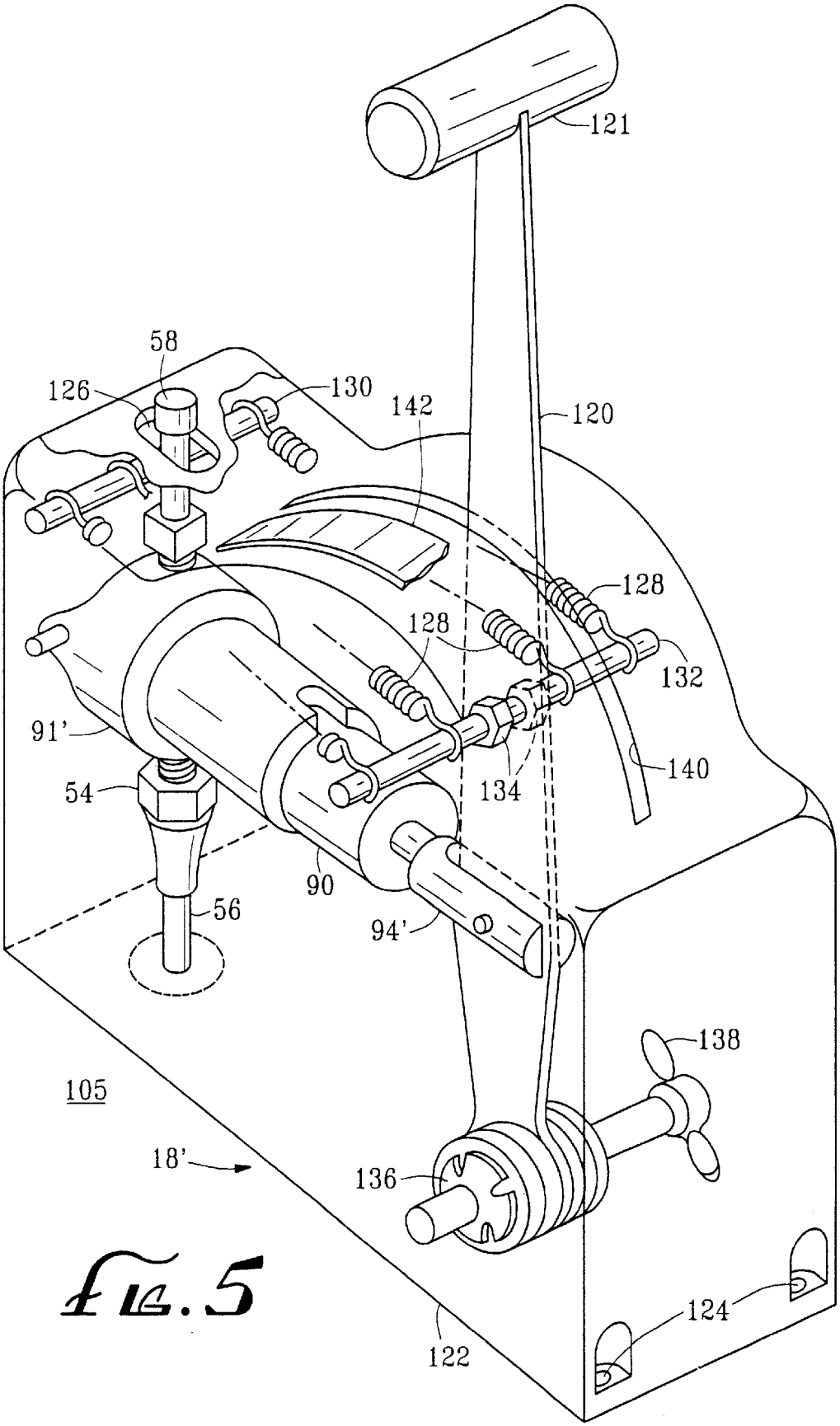
FIG. 5 is a fragmentary perspective view showing an alternative configuration of the control unit portion of FIG. 4.

With further reference to FIG. 5, an alternative configuration of the control unit, designated 18', has counterparts of the control cylinder 90 and the piston 92 (not shown) coupled to a control lever 120 having a handle portion 121 at a free extremity thereof. The control cylinder 90 has a counterpart of the head portion, designated 91', that is pivotally connected to a housing 122 to which the lever 120 is also pivotally connected. A counterpart of the piston rod, designated 94', is also pivotally connected to the lever 120 such that the handle portion 121 provides significant mechanical advantage for movement of the piston 92 within the cylinder 90. The housing 122 has fastener openings 124 for mounting to suitable structure such as the control panel 105, a counterpart of the fitting 54 is mounted to the head portion 91' in an orientation for suitable projection of the conduit 56 from the housing 122. Similarly, a counterpart of the bleed valve 58 projects oppositely from the fitting 54 and through a clearance slot 126 of the housing 122.

The control lever 120 is biased for movement in a direction corresponding to pressure feeding of fluid through the conduit 56 and into the power unit 14 by a plurality of extension springs 128, opposite ends of each spring 128 being hooked on an anchor bar 130 and a lever arm 132, respectively. The anchor bar 130 is transversely mounted within the housing 122 proximate the bleed valve 58. The lever arm projects from opposite sides of the lever 120 in parallel relation to the anchor bar 130, being fastened thereto by a pair of threaded nuts 134. Also, the pivotal connection of the lever 120 to the housing 122 is provided with a friction brake 136 for yieldably holding the lever 120 in a selected position thereof. The brake 136 is provided with an adjustment knob 138 that projects from the housing 122 for introducing a desired amount of frictional resistance to movement of the lever 120. Thus the springs 128 provide an effective force approximately balancing the biasing of the propeller unit 16 by the compression springs 84 thereof, the brake 136 being adjusted for providing slightly more than the additional resistance required for holding the control lever 120 in positions it is manually moved to so that an operator of the system 10 is not required to physically hold onto the handle portion 121 once a desired pitch setting is attained. The control lever 120 projects through an elongated lever slot 140 of the housing 122, the exposed portion of the lever 120 providing a convenient visual indication of the pitch setting. Further, the housing 122 can be provided with suitable indicia 142 along the slot 140 for indicating specific pitch settings.

Figure 6:
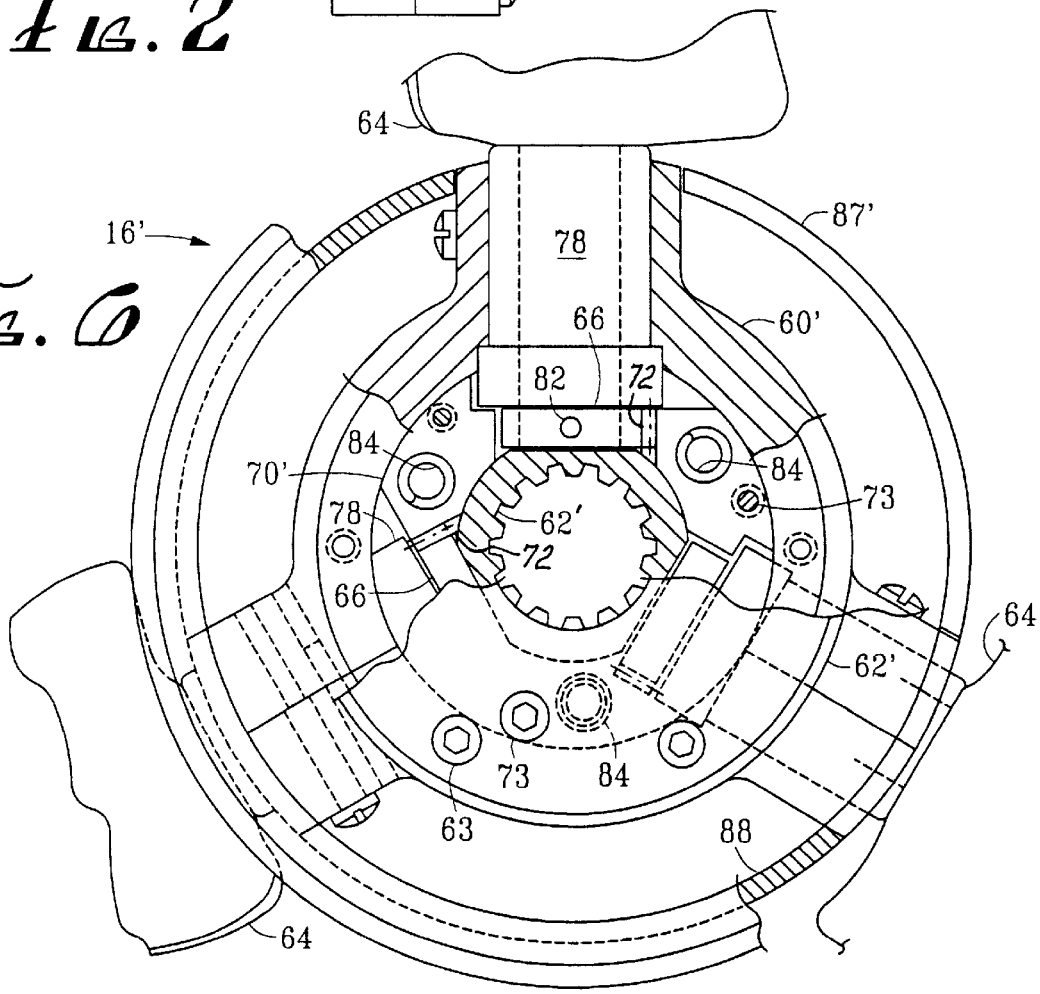
FIG. 6 is sectional view as in FIG. 2, showing an alternative configuration of the propeller unit of FIG. 2.

With further reference to FIG. 6, an alternative configuration of the propeller unit, designated 16', has three equally spaced counterparts of the blade members 64, the pinions, and the bearings 78. A counterpart of the hub, designated 60', is formed as three segments that are joined at the bearings 78 for facilitating fabrication and assembly as described above relative to the configuration of FIGS. 1–3. A counterpart of the flange member, designated 62', has three equally spaced flattened regions that provide clearance for the pinions 66 and for blocking the inward movement of the blade members 64 as described above in connection with FIGS. 2 and 3. As further shown in FIG. 6, the propeller unit 16' has a counterpart of the rack member, designated 70', having three of the rack sections 72 engaging corresponding pinions 66 of the blade members 64.

Figure 7:
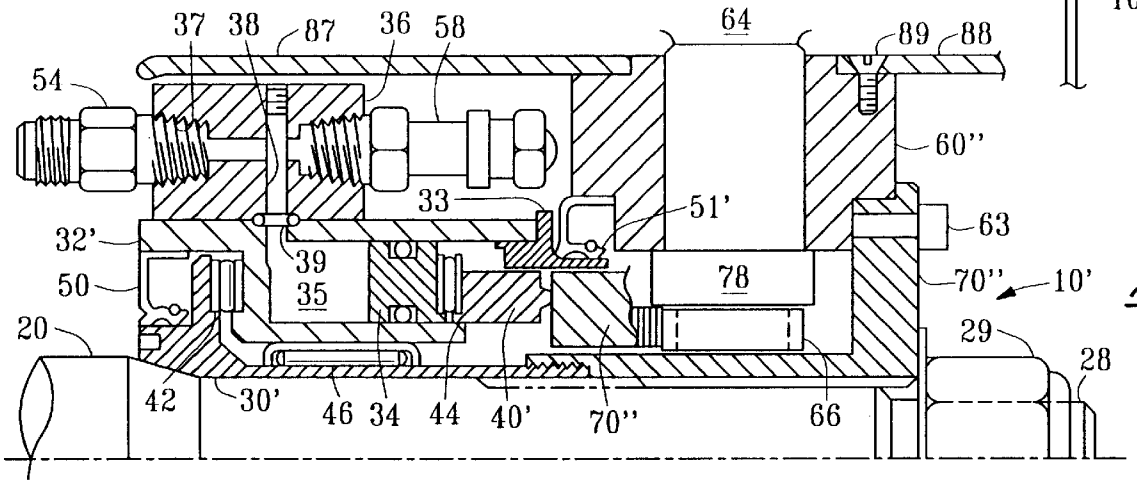
FIG. 7 is a lateral sectional view showing another alternative configuration of the propeller system of FIG. 1.

With further reference to FIG. 7, another alternative configuration of the system designated 10', has a counterpart of the rotary second seal, designated 51', supported on a counterpart of the hub, designated 60", the seal 51' sealingly contacts a cylinder extension 33 that projects from a counterpart of the annular hydraulic cylinder, designated 32'. The cylinder extension advantageously permits the sealing contact to be at reduced diameter for correspondingly reduced frictional drag by the seal 51', and for permitting a more compact seal to be utilized than otherwise. As further shown in FIG. 7, the flange member 62" can be formed for being fixedly connected to a counterpart of the spindle, designated 30', such as by threaded engagement that preferably forms a water-tight connection. The power unit 14 and the propeller unit 16 being thus connected, they would be installed and removed from the shaft 20 as a single unit, thereby maintaining the sealed environment of the piston 34. As further shown in FIG. 7, the system 10' has a counterpart of the rack member, designated 70", without having the groove 74 formed therein.

The system 10 of the present invention thus avoids rotating oil seals that are subject to leakage and have short life spans. The O rings 48 and 49 operating in the stationary hydraulic cylinder 32 have minimum travel; and no rotation, and the needle thrust bearing 44 next to the piston 34 and having high loading capacity and requiring very little lubrication, allows the propeller blade members 64, which are rotating, to be positioned by the stationary hydraulic cylinder. The blade members 64 can be feathered, a particularly advantageous feature for sail boats. For bass fishing, by being able to lower the pitch of the propeller blades, sufficiently low boat speeds are practical that an extra trolling motor is not needed.

Although the present invention has been described in considerable detail with reference to certain preferred versions thereof, other versions are possible. For example, the hydraulic cylinder 32 can be rigidly anchored to the base member 22, the first thrust bearing 42 not being required. Also, more than one outboard or inboard engine can be provided with counterparts of the system 10, using a single control unit 18 (having dual hydraulic cylinders), even if the propellers operate in opposite directions. Further, larger marine propellers may be positioned with the control unit 18 utilizing an engine-driven hydraulic pump and having a pressure regulator. Therefore, the spirit and scope of the appended claims should not necessarily be limited to the description of the preferred versions contained herein.

What is claimed is:

1. A modular variable pitch propeller system for a driven shaft having a locating surface, a torque-transmitting surface, and a retainer surface for engagement by a retaining device, the shaft extending from a base structure, the system comprising:

(a) a power unit having a spindle for coupling to the shaft and rotation therewith, an annular hydraulic cylinder rotatably supportable relative to the spindle and having a fluid port and means for preventing rotation of the cylinder by mechanical coupling to the base structure, a piston slidably engaging the cylinder in sealed relation therewith and coupling fluid flow relative to the port with axial movement of the piston, a piston yoke axially movably supported relative to the spindle, a first thrust bearing for transmitting axial force between the spindle and the cylinder, and a second thrust bearing for transmitting axial force between the piston and the piston yoke, whereby the piston yoke moves axially relative to the spindle in response to fluid flow into the port, and the spindle and the piston yoke can be rotated by the shaft while the cylinder and the piston are being prevented from rotation by the coupling to the base; and (b) a propeller unit having a hub for coupling to the torque-transmitting surface of the shaft and rotation therewith, a plurality of radially projecting blade members movably supported relative to the hub, a propeller yoke axially movable relative to the hub, and means for moving the blade members relative to the hub in response to axial movement of the propeller yoke, the power unit being locatable adjacent the propeller unit opposite the retainer device whereby the axial force is transmitted from the locating surface, through the power unit to the propeller yoke by axial facing contact with the piston yoke, and through the means for moving and the hub to the retainer device, the blade members moving from a first position toward a second position relative to the hub in response to the fluid flow into the port.

2. The propeller system of claim 1, wherein the first and second thrust bearings are antifriction bearings.

3. The propeller system of claim 2, wherein at least one of the first and second thrust bearings is a needle thrust bearing.

4. The propeller system of claim 1, further comprising means for biasing the piston against the fluid flow into the port for retraction of the piston relative to the cylinder when fluid is allowed to flow out of the port, in response to reduced fluid pressure, the blade members correspondingly moving toward the first position.

5. The propeller system of claim 4, wherein the means for biasing comprises a spring for urging the propeller yoke axially toward the piston yoke relative to the hub.

6. The propeller system of claim 1, wherein the shaft is operable submerged in water, the system further comprising power unit seal means for excluding water from the piston and the thrust bearings.

7. The propeller system of claim 6, wherein the power unit seal means comprises a rotary first seal between the spindle and the cylinder, a rotary second seal between the spindle and the piston yoke, and an axial third seal between the cylinder and the piston yoke.

8. The propeller system of claim 6, wherein the power unit seal means comprises a rotary first seal between the spindle and the cylinder, and a rotary second seal between the cylinder and the hub.

9. The propeller system of claim 1, wherein the means for preventing rotation comprises the fluid port being formed for engagement by a hydraulic fitting having a conduit extending therefrom, and a mechanical connection between the conduit and the base.

10. The propeller system of claim 1, wherein the spindle is adapted for being clamped between the locating surface and the hub by the retainer device.

11. The propeller system of claim 1, further comprising radial bearing means for concentrically supporting the cylinder relative to the spindle.

12. The propeller system of claim 11, wherein the radial bearing means comprises a needle bearing assembly fixedly located within the cylinder and rollably engaging the spindle.

13. The propeller system of claim 1, wherein the means for moving comprises each blade member being rotatably mounted on a respective radially extending axis of the hub and having a pinion fixedly connected thereto, and the propeller yoke including axially extending rack elements engaging corresponding ones of the pinions.

14. The propeller system of claim 13, comprising two of the blade members, the blade members projecting from opposite sides of the hub.

15. The propeller system of claim 13, comprising three of the blade members, the blade members projecting in equally spaced relation to the hub.

16. The propeller system of claim 1, further comprising a control device being fluid-connected to the fluid port, the control device comprising a hydraulic control cylinder having a control port, a control piston sealingly axially movable in the control cylinder, conduit means for fluid-connecting the control port to the fluid port of the annular hydraulic cylinder, means for adjustably positioning the control piston, and means for holding the control piston against hydraulic pressure being used for operating the power unit.

17. The propeller system of claim 16, wherein the means for positioning the control piston comprises a control lever coupled thereto, and the means for holding comprises control biasing means and a friction brake coupled between the control piston and the control cylinder.

18. The propeller system of claim 16, wherein the means for positioning the control piston comprises a threaded control rod coupled thereto, a control knob rotatably mounted relative to the control cylinder and threadingly engaging the control rod for axial movement thereof, an indicator element extending from the control rod and being exposed for indicating relative position of the control piston, and the means for holding comprises a working angle of engagement between the control rod and the knob being sufficiently high to frictionally lock the nut against rotation in response to axial loading of the control rod.

19. A modular variable pitch propeller system for a driven shaft having a locating surface, a torque-transmitting surface, and a retainer surface for engagement by a retaining device, the shaft extending from a base structure and being operable submerged in water, the system comprising:

(a) a power unit having a spindle for coupling to the shaft and rotation therewith, an annular hydraulic cylinder rotatably supportable relative to the spindle and having a fluid port and means for preventing rotation of the cylinder by mechanical coupling to the base structure, a bearing array being located within the cylinder and rollably engaging the spindle for maintaining the cylinder concentric with the spindle, a piston slidably engaging the cylinder in sealed relation therewith and coupling fluid flow relative to the port with axial movement of the piston, a piston yoke axially movably supported relative to the spindle, a first thrust bearing for transmitting axial force between the spindle and the cylinder, a second thrust bearing for transmitting axial force between the piston and the piston yoke, and power unit seal means including a rotary first seal between the spindle and the cylinder, a rotary second seal between the spindle and the piston yoke, and an axial third seal between the cylinder and the piston yoke for excluding water from the piston and the thrust bearings, whereby the piston yoke moves axially relative to the spindle in response to fluid flow into the port, and the spindle and the piston yoke can be rotated by the shaft while the cylinder and the piston are being prevented from rotation by the coupling to the base;

(b) a propeller unit having a hub for coupling to the torque-transmitting surface of the shaft and rotation therewith, a plurality of blade members radially projecting from the hub, each blade member being rotatably mounted on a respective radially extending axis of the hub and having a pinion fixedly connected thereto, a propeller yoke axially movable relative to the hub, the propeller yoke including axially extending rack elements engaging corresponding ones of the pinions for moving the blade members relative to the hub in response to axial movement of the propeller yoke, and a spring for urging the propeller yoke axially toward the piston yoke relative to the hub for biasing the piston against the fluid flow into the port for retraction of the piston relative to the cylinder when fluid is allowed to flow out of the port, in response to reduced fluid pressure, the blade members correspondingly moving toward the first position, the power unit being locatable adjacent the propeller unit opposite the retainer device with the spindle clamped between the locating surface and the hub by the retainer device, the axial force being transmitted from the locating surface, through the power unit to the propeller yoke by axial facing contact with the piston yoke, and through the means for moving and the hub to the retainer device, the blade members moving from a first position toward a second position relative to the hub in response to the fluid flow into the port; and (c) a control device comprising a hydraulic control cylinder having a control port, a control piston sealingly axially movable in the control cylinder, a conduit fluid-connecting the control port to the fluid port of the annular hydraulic cylinder, a mechanism for adjustably positioning the control piston and holding the control piston against hydraulic pressure being used for operating the power unit, and an indicator for displaying the position of the control piston.

20. The propeller system of claim 13, wherein the blade members are rotatable on the respective axes of the hub over a range of approximately 79 degrees in response to axial movement of the piston.

21. A modular variable pitch propeller system for a driven shaft having a torque-transmitting surface, and a retainer surface for engagement by a retaining device, the shaft extending from a base structure, the system comprising:

(a) a power unit having an annular hydraulic cylinder rotatably supportable relative to the spindle and having a fluid port and means for preventing rotation of the cylinder by mechanical coupling to the base structure, a piston slidably engaging the cylinder in sealed relation therewith and coupling fluid flow relative to the port with axial movement of the piston, a piston yoke axially movably supported relative to the spindle, a thrust bearing for transmitting axial force between the piston and the piston yoke, whereby the piston yoke moves axially relative to the spindle in response to fluid flow into the port, and the piston yoke is rotatable when the cylinder and the piston are being prevented from rotation by the coupling to the base; and (b) a propeller unit having a hub for coupling to the torque-transmitting surface of the shaft and rotation therewith, a plurality of radially projecting blade members movably supported relative to the hub, a propeller yoke axially movable relative to the hub, and means for moving the blade members relative to the hub in response to axial movement of the propeller yoke, the power unit being locatable adjacent the propeller unit opposite the retainer device with the piston yoke in axial facing contact with the propeller yoke whereby the axial force is transmitted to the propeller yoke by the piston yoke, and through the means for moving and the hub to the retainer device, the blade members moving from a first position toward a second position relative to the hub in response to the fluid flow into the port, and the retainer device and power unit being removable from the shaft without disturbing the power unit.

22. The propeller system of claim 21, wherein the thrust bearing is a needle thrust bearing.

23. The propeller system of claim 21, further comprising a spring for urging the propeller yoke axially toward the piston yoke relative to the hub for retraction of the piston relative to the cylinder when fluid is allowed to flow out of the port in response to reduced fluid pressure, the blade members correspondingly moving toward the first position.

24. The propeller system of claim 21, wherein the shaft is operable submerged in a fluid, the system further comprising power unit seal means for excluding water from the piston and the thrust bearings, comprising moving seals consisting of a rotary first seal between the cylinder and an element on the shaft, a rotary second seal between the element on the shaft and the piston yoke, and an axial third seal between the cylinder and the piston yoke, the power unit seal means remaining effective during the removal of the retainer device and the power unit.

25. The propeller system of claim 21, wherein the means for preventing rotation comprises the fluid port being formed for engagement by a hydraulic fitting having a conduit extending therefrom, and a mechanical connection between the conduit and the base.

26. The propeller system of claim 21, further comprising an antifriction bearing for concentrically supporting the cylinder relative to the spindle.

27. The propeller system of claim 21, wherein the blade members are rotatably mounted on respective equally spaced radially extending axes of the hub and the means for moving comprises each blade member having a pinion fixedly connected thereto, and the propeller yoke including axially extending rack elements engaging corresponding ones of the pinions.

28. The propeller system of claim 21, further comprising a control device being fluid-connected to the fluid port, the control device comprising a hydraulic control cylinder having a control port, a control piston sealingly axially movable in the control cylinder, conduit means for fluid-connecting the control port to the fluid port of the annular hydraulic cylinder, means for adjustably positioning the control piston, and means for holding the control piston against hydraulic pressure being used for operating the power unit.

29. A modular variable pitch propeller system for a driven shaft having locating and torque-transmitting surfaces, and a retainer surface for engagement by a retaining device, the shaft extending from a base structure and being operable submerged in a fluid, the system comprising:

(a) a power unit having a spindle for fixably rotating with the shaft, an annular hydraulic cylinder rotatably supportable relative to the spindle and having a fluid port and means for preventing rotation of the cylinder by mechanical coupling to the base structure, a piston slidably engaging the cylinder in sealed relation therewith and coupling fluid flow relative to the port with axial movement of the piston, a piston yoke axially movably supported relative to the spindle, a thrust bearing for transmitting axial force between the piston and the piston yoke, whereby the piston yoke moves axially relative to the spindle in response to fluid flow into the port, and the spindle and the piston yoke can be rotated by the shaft while the cylinder and the piston are being prevented from rotation by the coupling to the base;

(b) a propeller unit having a hub for fixably connecting to the spindle and rotating therewith, a plurality of radially projecting blade members movably supported relative to the hub, a propeller yoke axially movable relative to the hub, and means for moving the blade members relative to the hub in response to axial movement of the propeller yoke; and (c) means for excluding the fluid from the piston and the thrust bearing, comprising moving seals consisting of a rotary first seal between the cylinder and the spindle, and a rotary second seal between the cylinder and the hub, the power unit being locatable adjacent the propeller unit opposite the retainer device whereby the axial force is transmitted from the spindle through the cylinder, the piston, the thrust bearing and the piston yoke to the propeller yoke, and through the means for moving to the hub, the blade members moving from a first position toward a second position relative to the hub in response to the fluid flow into the port.

* * * * *